United States Patent [19]

Morozumi et al.

[11] Patent Number: 4,836,164

[45] Date of Patent: Jun. 6, 1989

[54] ENGINE SPEED CONTROL SYSTEM FOR AN AUTOMOTIVE ENGINE

[75] Inventors: Takuro Morozumi, Mitaka; Masanori Sakamoto, Hamura, both of Japan

[73] Assignee: Fuji Jukogyo Kabushiki Kaisha, Tokyo, Japan

[21] Appl. No.: 107,653

[22] Filed: Oct. 9, 1987

[30] Foreign Application Priority Data

Oct. 16, 1986 [JP] Japan ..... 61-246155

[51] Int. Cl.[4] ..... F02D 41/04

[52] U.S. Cl. ..... 123/339; 123/478

[58] Field of Search ..... 123/339, 585, 478, 480; 62/323.1

[56] References Cited

U.S. PATENT DOCUMENTS 4,365,299 12/1982 Kondo et al. ..... 123/480

4,625,281 11/1986 Deutsch ..... 123/339

FOREIGN PATENT DOCUMENTS 58-5438 1/1983 Japan .

60-69246 4/1985 Japan ..... 123/339

*Primary Examiner*—Andrew M. Dolinar

*Attorney, Agent, or Firm*—Martin A. Farber

[57] ABSTRACT

A system for controlling speed of an engine for a motor vehicle having an air-conditioner at idling of an automotive engine. The engine has a fuel injection system, a bypass provided around a throttle valve, an auxiliary air valve, and a control unit responsive to the closing of an air-conditioner switch for the air-conditioner for opening the auxiliary air valve, thereby increasing intake air. In response to the closing of the air-conditioner switch the quantity of fuel injected in the engine is temporarily increased, thereby increasing engine speed in accordance with the increase of the intake air.

7 Claims, 4 Drawing Sheets

ENGINE SPEED CONTROL SYSTEM FOR AN AUTOMOTIVE ENGINE

BACKGROUND OF THE INVENTION

The present invention relates to a system for controlling speed of an automotive engine having an electronic fuel-injection system, and more particularly, to a control system operative during the idling of the automotive engine.

In an idle speed control system for a vehicle having an air-conditioner, the idle speed of an engine must be increased when the air-conditioner is operated. In order to control the idle speed of the engine during the operation of the air-conditioner, a bypass having an auxiliary air valve is provided around a throttle valve of the engine. The auxiliary air valve is opened, when an air-conditioner switch is turned on for operating the air-conditioner. Thus, the amount of intake air increases, the increase of which is detected by an air-flow meter. In response to the increase of intake air, the fuel injection system operates to increase the fuel, thereby increasing the engine idle speed.

However, since the air-flow meter is disposed upstream and far from the auxiliary air valve, the increase of intake air is detected after considerable amount of air has passed the air-flow meter. Accordingly, the increase of fuel is retarded.

As shown in FIG. 5, the idle speed is controlled to keep 700 rpm, the air-fuel ratio at which is about 14.7 (stoichiometric air-fuel ratio). When the air conditioner switch is turned on, the air-fuel mixture is temporarily diluted so that engine speed drops to about 500 rpm. The engine speed reaches a higher idle speed of 850 rpm with a delay. Therefore, the engine idle speed becomes irregular because of an increase of load at a decrease of idle speed.

Japanese Patent Laid Open 58-5438 discloses an engine speed control system for increasing the amount of fuel at starting of a vehicle in order to improve starting characteristic of the vehicle. However, the system is not available for resolving the above problems.

SUMMARY OF THE INVENTION

The object of the present invention is to provide an idle speed control system wherein the air-fuel mixture at the start of the air-conditioner is prevented from becoming too lean so that a stable engine operation may be obtained.

The other objects and features of this invention will become understood from the following description with reference to the accompanying drawings.

DETAILED DESCRIPTION OF THE PREFERRED EMBODIMENT

Figure 1:
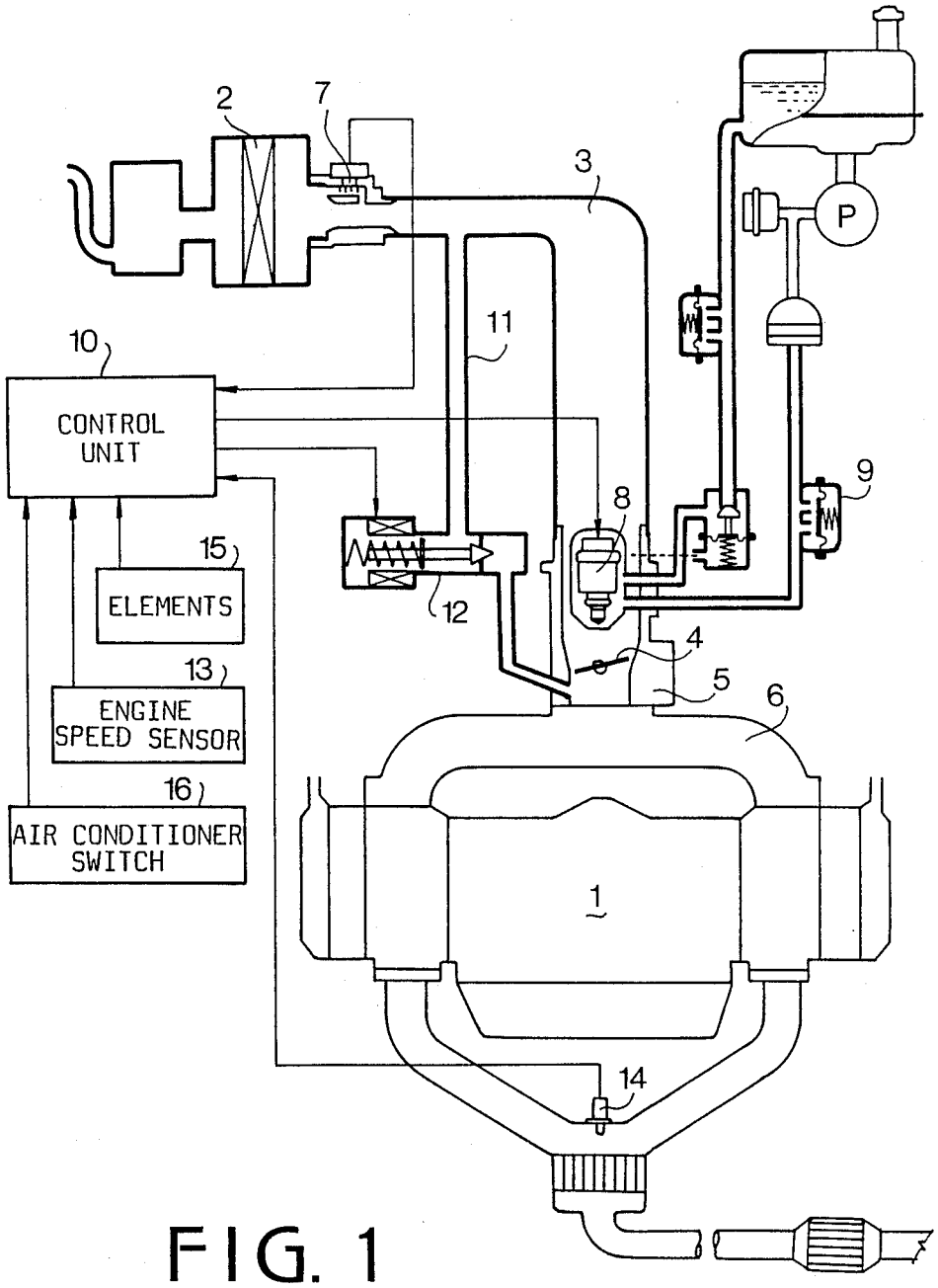
FIG. 1 is a schematic illustration showing a system for controlling the operation of an internal combustion engine for a motor vehicle.

Referring to FIG. 1, an internal combustion engine 1 for a motor vehicle is supplied with air through an air cleaner 2, intake pipe 3, throttle valve 4 in a throttle body 5, and an intake manifold 6, mixing with fuel injected from a single point injector 8.

Fuel in a fuel tank is supplied to the injector 8 by a fuel pump P through a pressure damper 9. A solenoid operated auxiliary air valve 12, is provided in a bypass 11 around the throttle valve 4. A mass air-flow meter 7 is provided on the intake pipe 3 and an $O_2$-sensor 14 is provided in an exhaust pipe. Output signals of the meter 7 and the sensor 14 are applied to a control unit 10. The control unit 10 is also applied with output signals from an engine speed sensor 13, an air conditioner switch 16 and various other elements 15 such as coolant temperature sensor, starter switch and intake air temperature sensor. The control unit 10 produces actuating signal to control the injector 8 and the solenoid operated auxiliary valve 12.

Figure 2:
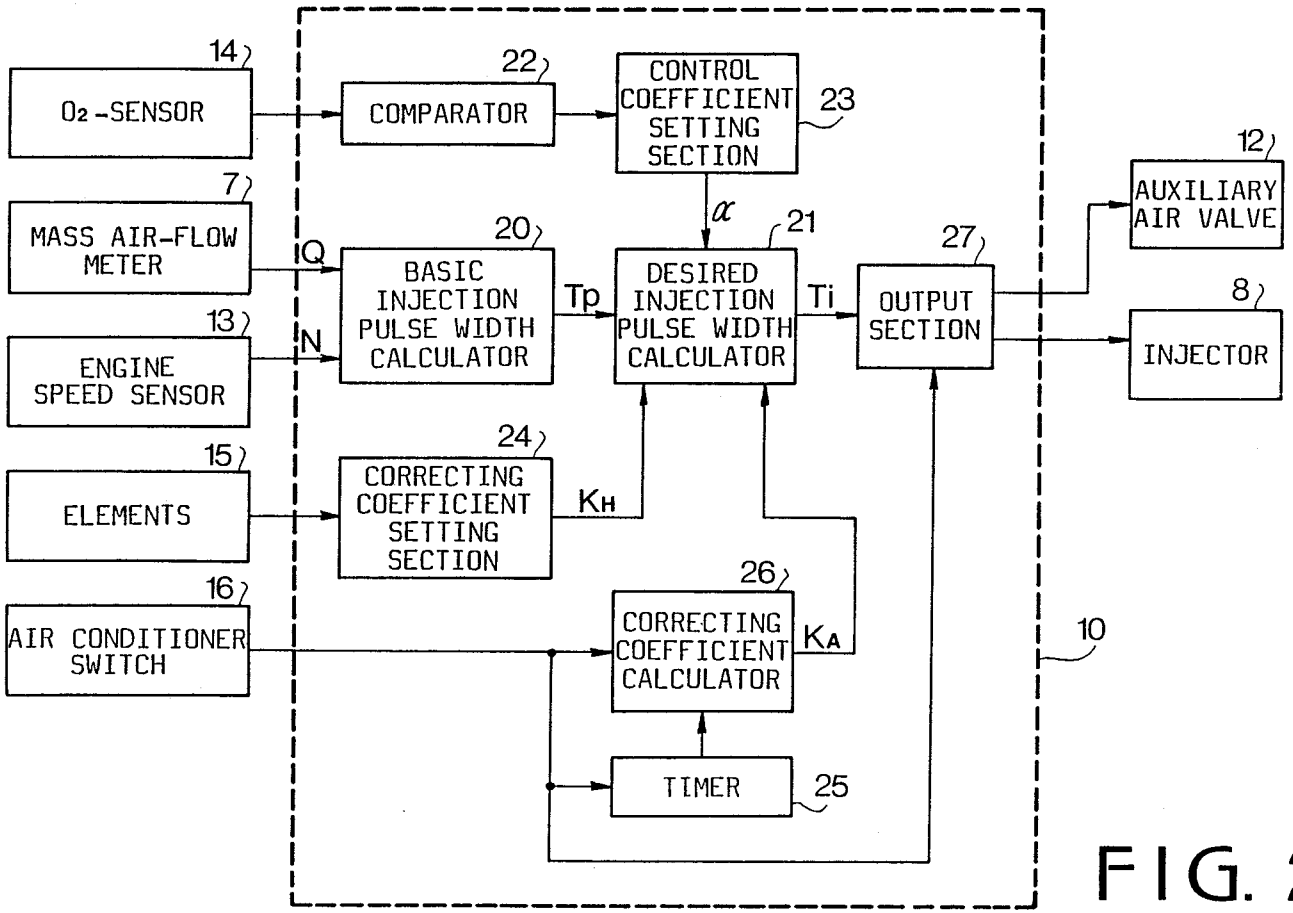
FIG. 2 is a block diagram of a control unit used in a system of the present invention.

Referring to FIG. 2, the control unit 10 is an electronic fuel injection system and comprises a basic injection pulse width calculator 20 to which a mass air flow signal Q from the mass air-flow meter 7 and an engine speed signal N from the engine speed sensor 13 are applied. Basic injection pulse width $T_p$ can be obtained by the following equation;

$$T_p = K \times Q/N, \text{ (K is a constant.)}$$

The output signal $T_p$ is applied to a desired injection pulse width calculator 21 to obtain a desired injection pulse width $T_i$ by correcting the basic injection pulse width $T_p$ in accordance with engine operating conditions.

In order to correct the injection pulse width, a comparator 22 to which a feedback signal from the $O_2$-sensor 14 is applied, is provided in the control unit 10. The feedback signal is compared with a reference value corresponding to stoichiometric air-fuel ratio to decide whether the air-fuel mixture is appropriate or not. When the actual air-fuel ratio is rich or lean compared with the stoichiometric air-fuel ratio, the comparator 22 produces an error signal. A control coefficient setting section 23 applies a control coefficient signal $\alpha$ to the desired injection pulse width calculator 21 in response to the error signal. A correcting coefficient setting section 24 also applies a correcting coefficient $K_H$ to the calculator 21 in accordance with the output signals of the correcting elements 15.

The control unit 10 further comprises a correcting coefficient calculator 26 to which an ON signal of the air-conditioner switch 16 is applied. A timer 25 which is also responsive to the ON signal applies a set time signal to the correcting coefficient calculator 26. The correcting coefficient calculator 26 sets an initial correcting coefficient $K_A$ in order to increase the amount of injection fuel during the set time t represented by the set time signal. At the same time, a decrement k for continuously decreasing the coefficient $K_A$ is calculated in the calculator 26 in accordance with an equation $k = K_A/t$. The coefficient $K_A$ gradually decreases with time by the decrement k, and when the set time t lapses, the coefficient $K_A$ becomes zero. If the output signal of the air-conditioner switch 16 changes to an OFF signal during the set time t, the coefficient $K_A$ instantly becomes zero.

Thus, the desired fuel injection pulse width $T_i$ is obtained as follows;

$$T_i = T_p \cdot \alpha(1 + K_H + K_A) + T_S$$

($T_S$: pulse width for correcting the voltage applied to the injector)

An injection signal dependent on the pulse with $T_i$ is applied to the injector 8 through an output section 27. The ON signal of the air-conditioner switch 16 is further applied to the output section 27 which in turn produces an actuating signal to the solenoid operated auxiliary air valve 12 to open it.

The operation of the electronic fuel injection system is hereinafter described. When the air-conditioner is not used during the operation of the engine 1, the air flows into the intake manifold 6 in accordance with the opening degree of the throttle valve 4. Output signals of the mass air-flow meter 7, sensors 13 and 14, and elements 15 are supplied to the control unit 10 to obtain the desired injection pulse width $T_i$. The injection signal is applied to the injector 8 so as to inject fuel in accordance with the pulse width $T_i$. Accordingly, the air-fuel mixture converges to the stoichiometric ratio in a steady state and is enriched by the coefficient $K_H$ in accordance with engine operating conditions.

When the air-conditioner switch 16 is turned on, the solenoid operated auxiliary air valve 12 is opened. Therefore, the air flows into the intake manifold 6 through the bypass 11 as well as through the intake pipe 3, thereby increasing the mass air flow.

Figure 3:
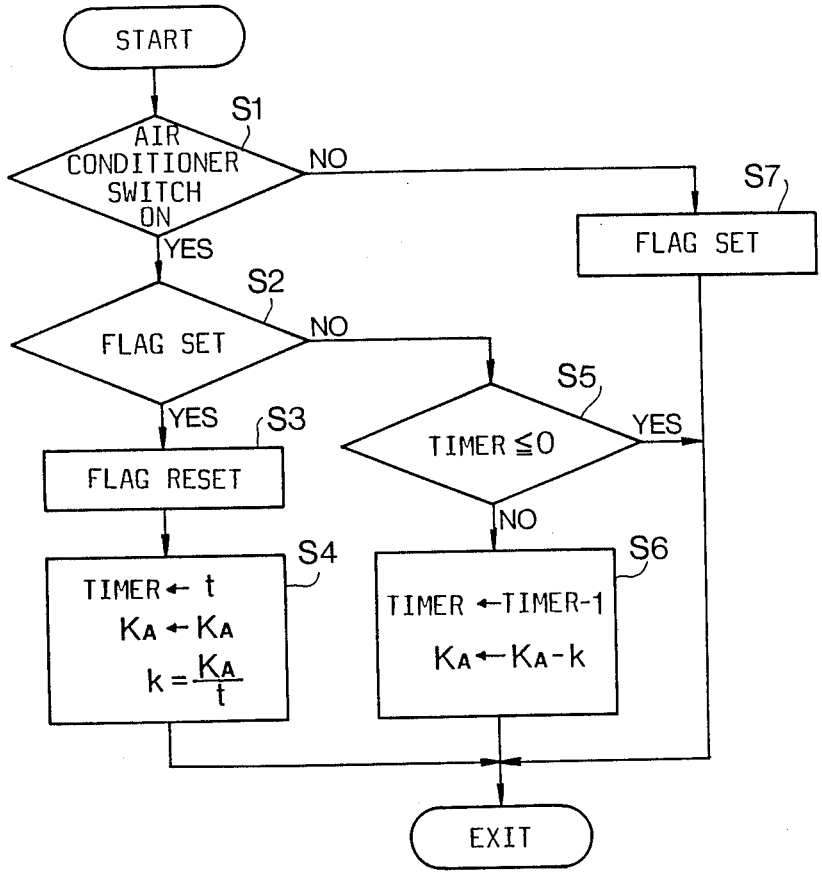
FIG. 3 is a flowchart showing the operation of the system of the present invention.
Figure 5:
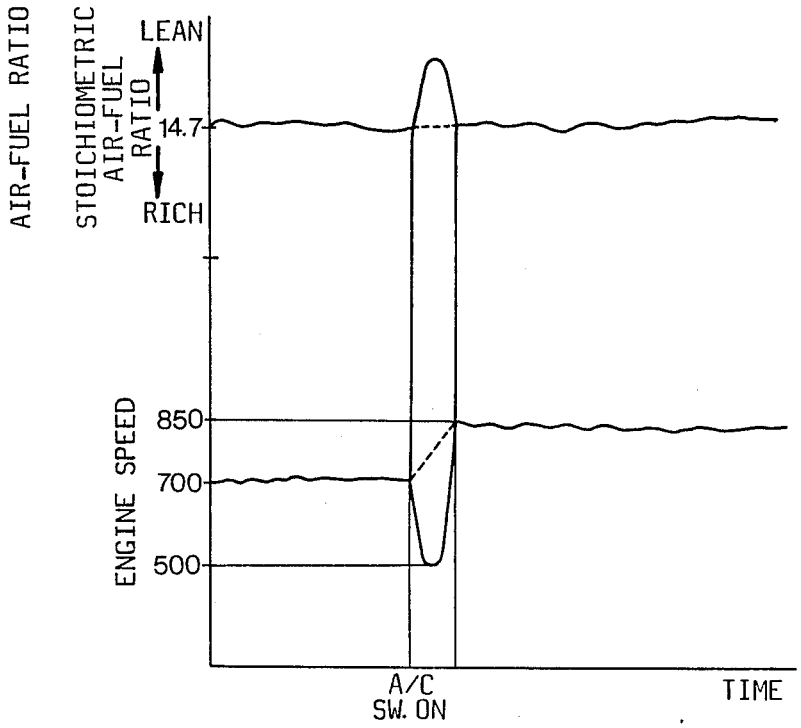
FIG. 5 is a graph showing changes in air-fuel ratio and engine speed at actuation of an air-conditioner.

Referring to the flowchart of FIG. 3, when it is determined that the air-conditioner switch 16 is turned on at a step S1, the program proceeds to a step S2. When the flag is set at step S2, it means that the program is a first loop immediately after the actuation of the air-conditioner, the program proceeds to a step S3, where the flag is reset. At a step S4, the timer is set to a set time t and the correcting coefficient $K_A$ is obtained, and a decrement k is also calculated. Thus, the correcting coefficient $K_A$ is added to the equation for obtaining the desired fuel injection pulse width $T_i$. Accordingly, the amount of fuel is increased so as to compensate the dilution of the mixture caused by increased intake air. Thus, as shown by the dotted line in FIG. 5, the air-fuel ratio is maintained approximately of the stoichiometric air-fuel ratio. As a result, as shown also by the dotted line in the same figure, the engine speed starts to increase right after the actuation of the air-conditioner.

Figure 4:
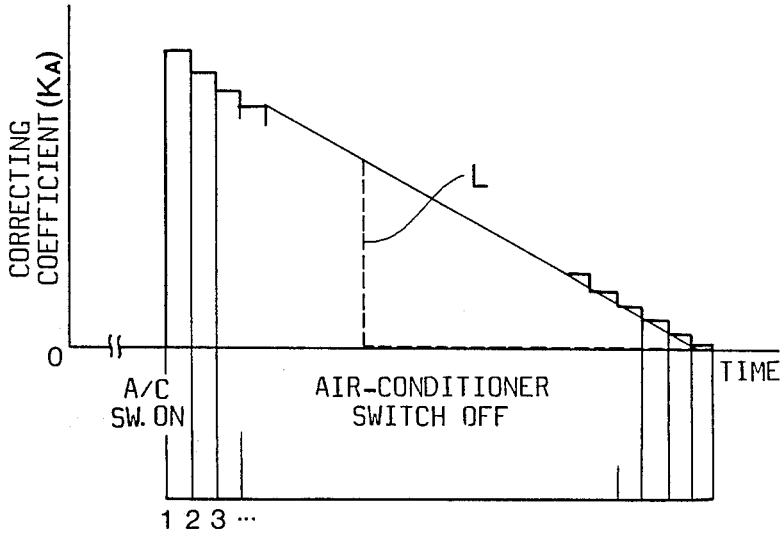
FIG. 4 is a graph showing characteristics of a correcting coefficient for increasing fuel.

In loops after the first loop, since the flag is reset, the program proceeds from step S2 to a step S5, where it is determined whether the remaining time in the timer is equal to or smaller than zero (Timer$\leqq$0) or not. If the value is larger than zero, the program proceeds to a step S6. At the step S6, the correcting coefficient $K_A$ is continuously decreased by the decrement k which was calculated at the step S4, and the set time in the timer is also reduced little by little. The operations at steps S5 and S6 are repeated until the set time becomes zero. Accordingly, as shown in FIG. 4, the value of the correcting coefficient $K_A$ for increasing the injected fuel decreases with time. Thus the increased amount of fuel to be injected gradually decreases. By the time the coefficient $K_A$ becomes zero, the air flow meter 7 is able to accurately detect the mass air flow so that it is needless to increase the injection of fuel by the coefficient $K_A$. Accordingly, when the set time t lapses, the coefficient calculator 26 stops generating the coefficient $K_A$.

If the air-conditioner switch 16 is turned off during the above-described operation, the program proceeds to a step S7 where the flag is set. The coefficient $K_A$ immediately turns to zero as shown by a dotted line L in FIG. 4, so as to terminate the correcting operation.

Although the correcting in the above described embodiment of the present invention is particularly effective during idling, since both the amount of air flow through the bypass 11 and the amount of fuel increment are very small, the operation has little influence on driving of a vehicle if the operation is performed during driving of the vehicle.

In the air-fuel ratio control system of the invention, the fuel is temporarily increased to compensate for the dilution occurring at the start of the air-conditioner, so that decrease in engine speed is prevented. Since the actual air-fuel ratio substantially coincides with the stoichiometric ratio, the fuel consumption and emission control are improved.

While the presently preferred embodiments of the present invention has been shown and described, it is to be understood that this disclosure is for the purpose of illustration and that various changes and modifications may be made without departing from the spirit and scope of the invention as set forth in the appended claims.

What is claimed is:

1. In a system for controlling speed of an engine for a motor vehicle having an air-conditioner, the engine having a fuel injection system for injecting fuel for the engine, a bypass provided around a throttle valve, an auxiliary air valve in the bypass, and a control unit for controlling the fuel injection system for injecting the fuel and the auxiliary air valve and being responsive to closing of an air-conditioner switch for the air-conditioner upon starting of the air-conditioner for opening the auxiliary air valve, the improvement of the system, wherein the control unit comprises:

first means responsive to the closing of the air-conditioner switch for setting an initial correcting coefficient for controlling the fuel injection system for injecting the fuel so as to increase amount of the injecting fuel;

timer means responsive to the closing of the air-conditioner switch for setting a set time and for producing a set time signal; and said first means responsive to the set time signal for calculating a decrement based on the initial correcting coefficient and said set time and for continuously decreasing the initial correcting coefficient so as to gradually decrease the correcting coefficient with time by the decrement for controlling the fuel injection system for injecting the fuel to obtain a stable operation at the starting of the air-conditioner.

2. The system according to claim 1, wherein said control unit further comprises a basic injection pulse width calculator for calculating a basic fuel injection pulse width as a function of air-flow into and speed of the engine and a desired fuel injection pulse width calculator for calculating a desired fuel injection pulse width from the product of said basic fuel injection pulse width and another term, said another term including said correcting coefficient.

3. The system according to claim 1, wherein said first means is further responsive to opening of the air-conditioner switch for immediately changing the correcting coefficient to zero for further controlling the fuel injection system for injecting the fuel.

4. In a system for controlling speed of an engine for a motor vehicle having an air-conditioner, the engine having a fuel injection system for injecting fuel for the engine, a bypass provided around a throttle valve, an auxiliary air valve in the bypass, and a control unit for controlling the fuel injection system for injecting the fuel and the auxiliary air valve and being responsive to closing of an air-conditioner switch for the air-conditioner upon starting of the air-conditioner for opening the auxiliary air valve, the improvement of the system, wherein the control unit comprises:

correcting coefficient calculating means responsive to the closing of the air-conditioner switch for setting an initial correcting coefficient for controlling the fuel injection system for injecting the fuel so as to increase amount of the injecting fuel;

timer means responsive to the closing of the air-conditioner switch for setting a set time and for producing a set time signal; and said correcting coefficient calculating means responsive to the set time signal for calculating a decrement and for continuously decreasing the initial correcting coefficient so as to gradually decrease the correcting coefficient with time by the decrement for controlling the fuel injection system for injecting the fuel to obtain a stable operation at the starting of the air-conditioner;

said control unit further comprises a basic injection pulse width calculator for calculating a basic fuel injection pulse width as a function of air-flow into and speed of the engine and a desired fuel injection pulse width calculator for calculating a desired fuel injection pulse width from the product of said basic fuel injection pulse width and another term, said another term including said correcting coefficient;

said another term includes the sum of said correcting coefficient and 1 and a term dependent on engine operating conditions, said control unit further comprises feedback control means for providing a control coefficient determined by feedback of signals from an $O_2$-sensor of exhaust gases from the engine and comparison of said signals with a stoichiometric air-fuel ratio, said desired fuel injection pulse width calculator for calculating said desired fuel injection pulse width from the product of said basic fuel injection pulse width, said another term and said control coefficient.

5. The system according to claim 4, wherein the fuel injection system is an electronic fuel injection system.

6. The system according to claim 4, wherein said decrement has a valve equal to the initial correcting coefficient divided by the set time.

7. The system according to claim 4, wherein said correcting coefficient calculating means determines the decrement by an equation including a term of the set time which is set in the timer means, whereby the decrement is a function of the set time.

* * * * *